United States Patent [19]

Lydell

[11] Patent Number: 4,644,456

[45] Date of Patent: Feb. 17, 1987

[54] PORTABLE UTILITY LAMP

[76] Inventor: Stig G. Lydell, 17 Mansfield Rd., New Haven, Conn. 06473

[21] Appl. No.: 802,314

[22] Filed: Nov. 27, 1985

[51] Int. Cl.[4] ..... F21V 15/00

[52] U.S. Cl. ..... 362/376; 362/377; 362/378

[58] Field of Search ..... 362/376, 377, 378, 396, 362/400, 387, 258

[56] References Cited

U.S. PATENT DOCUMENTS

| | | | |
|---|---|---|---|
| 1,777,003 | 9/1930 | Kollath | 362/376 |
| 2,178,907 | 11/1939 | Hockley | 362/376 |
| 2,448,582 | 9/1948 | Fike | 362/376 X |
| 2,458,371 | 1/1949 | Grice | 362/377 |
| 2,460,173 | 1/1949 | Halbing | 362/376 |
| 2,569,068 | 9/1951 | Maxwell | 362/376 |
| 2,608,643 | 8/1952 | Day | 362/376 |
| 2,812,423 | 11/1957 | Penna | 362/376 |
| 3,244,873 | 4/1966 | Leutheuser | 362/376 |
| 3,808,420 | 4/1974 | Gortner | 362/396 |
| 3,996,459 | 12/1976 | Schwartz | 362/344 |
| 4,128,226 | 12/1978 | Ross | 362/376 |
| 4,141,062 | 2/1979 | Trueblood | 362/378 |
| 4,236,195 | 11/1980 | Kovacik | 362/376 |
| 4,275,435 | 6/1981 | Dorn | 362/378 |
| 4,298,922 | 11/1981 | Hardwick | 362/376 |
| 4,369,487 | 1/1983 | Carlow | 362/378 |

*Primary Examiner*—E. Rollins Cross

*Attorney, Agent, or Firm*—Lawrence Hager

[57] ABSTRACT

A utility lamp having a handle containing a receptacle outlet and an electrical cord at its bottom end. A bulb cage is affixed to the handle to protectively enclose a bulb inserted into a bulb receptacle. The bulb cage includes a triangular shaped reflector having a plurality of back light slits. A hook is swively mounted to an elongate tube, which is affixed to the reflector. A plurality of spring biased gripping fingers are mounted within the tube and are extendable without the upper end of the tube to facilitate hanging the utility lamp on a projecting means such as a screw.

9 Claims, 5 Drawing Figures

PORTABLE UTILITY LAMP

FIELD OF THE INVENTION

This invention relates to a lamp device and, more particularly, to an improved utility lamp for illuminating a work site or other types of areas.

BACKGROUND OF THE INVENTION

Various types of utility lamps have hitherto been proposed such as a utility lamp having an integrally formed cord storage section about which the length of cord extending from the handle can be wound, as is described in U.S. Pat. No. 4,369,487 issued Jan. 18, 1983 to Arther J. Carlow.

Another prior are portable lamp device is shown in U.S. Pat. No. 1,777,003 issued Sept. 30, 1930 to Francis C. Kollath. This patent describes a lamp having a clamping member 11 with two parts forming jaws and handles.

Other prior art patents of interest include U.S. Pat. Nos.: 3,244,873 issued Apr. 5, 1966 to Andrew Leutheuser; 3,996,459 issued Dec. 7, 1976 to Frederic W. Schwartz; 4,141,062 issued Feb. 20, 1979 to Raymond L. Trueblood; 4,298,922 issued Nov. 3, 1981 to Cret E. Hardwick; 2,569,068 issued Sept. 25, 1951 to John Maxwell; 2,608,643 issued Aug. 26, 1952 to Thurman L. Day; 4,413,312 issued Nov. 1, 1983 to Charles E. Morkosky et al, 2,460,173 issued Jan. 25, 1949 to Anthony T. Halbing; 2,458,371 issued Jan. 4, 1949 to George F. Grice; 2,448,582 issued Sept. 7, 1948 to Floyd M. Fike; 2,178,907 issued Nov. 7, 1939 to Owen Arthur Hockley; 4,128,226 issued Dec. 5, 1978 to Mervin L. Ross; and 4,808,420 issued Apr. 30, 1974 to James L. Gortner.

The above noted patents are mentioned as being representative of the prior art and other pertinent references may exist. None of these patents are deemed to affect the patentability of the present claimed invention.

In contrast to the prior art, the present invention provides a utility lamp having a generally triangular shaped reflector-cage, a 360 degree swivel hook, collapsible tongs projectable upwardly above said swivel hook to enable clamping on small projecting objects, directional slits in the reflector to provide some back lighting at the rear of the lamp, an outlet receptacle at the base of the lamp and a contoured protective cage having vertical grill members and being pivotally mounted at an upper portion.

SUMMARY OF THE INVENTION

Generally speaking, in accordance with the invention, a utility lamp device is provided having particular utility for facilitating disposition, mounting and illumination of a selected area, comprising:

a handle having a contoured configuration, and having an electrical outlet means at its bottom end;

an electrical cord having one end extending into a bottom portion of said handle and having its other end terminated by an electrical connector plug means;

a triangular or angled reflector having a plurality of slits or cutout portions to enable back-lighting;

an elongate tube means having a plunger actuator at one end in juxtaposition with said handle and a plurality of gripper fingers or prongs means mounted to the upper end of said tube means and being actuatable with manual actuation of said plunger actuator;

hook means being rotatably and slidably mounted to a portion of said tube means; and a protective cage means pivotally mounted at an upper end portion of said reflector and/or said tube means, and having a plurality of lengthwise contoured wire or grill like members.

Accordingly, it is an object of the present invention to provide a new and improved utility lamp.

Another object of the present invention is to provide a utility lamp having a reflector with flat surfaces to facilitate placement of the lamp on a flat surface.

Another object of the present invention is to provide a utility lamp having a new and improved cage.

Another object of the present invention is to provide a utility lamp having an upper spring biased gripper means actuatable by an actuator mounted at the handle of the lamp.

Another object of the present invention is to provide a utility lamp having a hook means which is 360 degree rotatable and/or upwardly-downwardly disposable.

Another object of the present invention is to provide a utility lamp having an electrical outlet at the bottom end of its handle.

Another object of the present invention is to provide a utility lamp having a reflector with a plurality of slits to provide a relatively small amount of backward illumination.

BRIEF DESCRIPTION OF THE DRAWINGS

Other objects and advantages of the invention may be more clearly seen when viewed in conjunction with the accompanying drawings. Similar reference numerals refer to similar parts throughout.

DESCRIPTION OF THE PREFERRED EMBODIMENT

Figure 1:
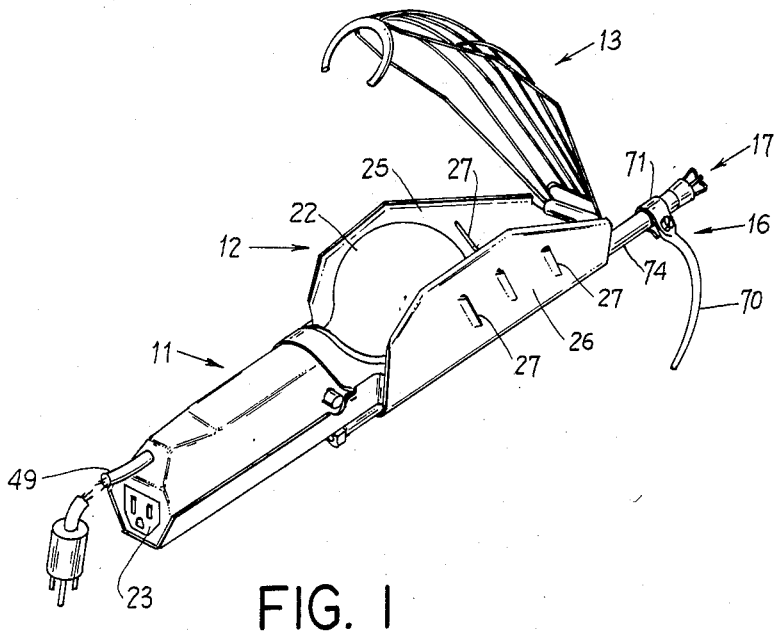
FIG. 1 is a perspective view of the utility lamp in accordance with the invention.
Figure 2:
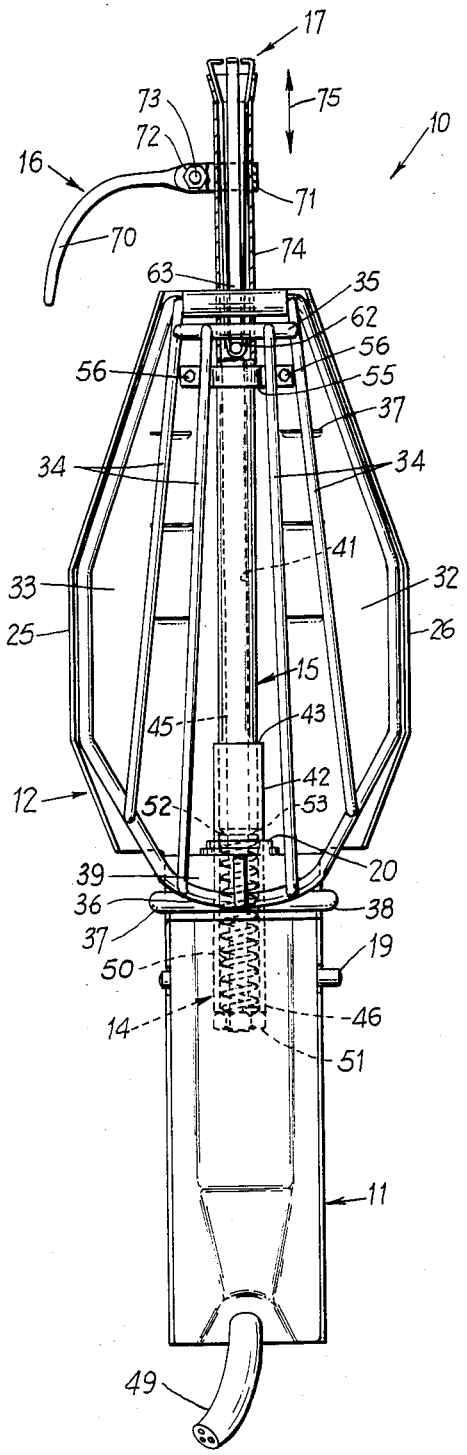
FIG. 2 is a front elevational view, partly in phantom outline of the utility lamp in accordance with the invention.
Figure 3:
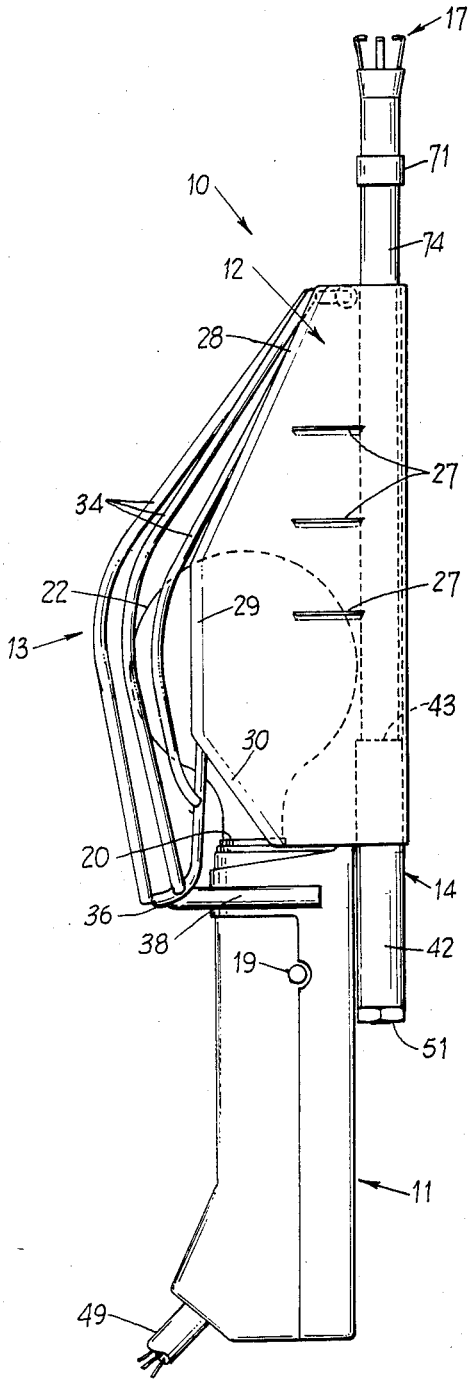
FIG. 3 is a side view, partly in phantom outline of the utility lamp in accordance with the invention.

Referring to FIGS. 1 thru 3 of the drawings, a utility lamp in accordance with the invention is indicated generally at 10 comprising a handle 11, a reflector 12, a protective cage 13, an actuating plunger 14, a tube member 15, a swivel hook 16, and end gripper prongs 17.

Figure 4:
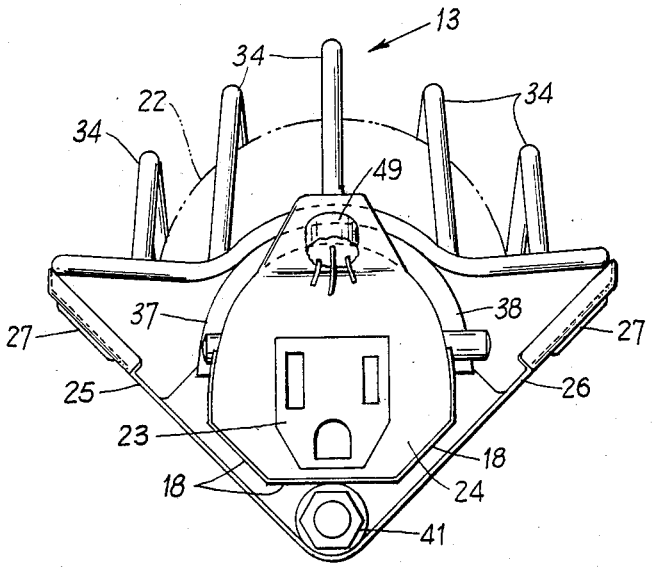
FIG. 4 is an end view of the utility lamp in accordance with the invention.
Figure 5:
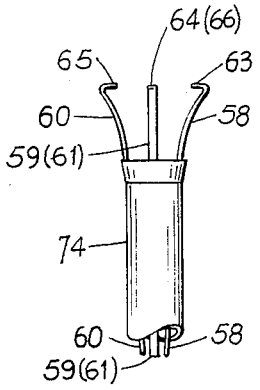
FIG. 5 is a perspective view, partly cutaway, of the gripper fingers extended without the tube means of the utility lamp in accordance with the invention.

Handle 11 preferably has an elongate contoured configuration with a plurality of flat surfaces 18 to facilitate gripping. A push-botton type on/off switch 19 is provided having conventional design. A standard switched threaded lamp receptacle or socket 20 is mounted in handle 11 and opens into reflector-cage assemble 21 so that it can receive a standard electrical bulb 22 shown in phantom outline in FIG. 1. The receptacle switch button 19 is accessible through the opposite sides of handle 11. A standard type electrical outlet or receptacle 23 is provided at the bottom end 24 of handle 11 (see FIG. 4). A standard three wire electrical cord 49 is mounted at the bottom end 24 of handle 11 and by conventional means is electrically connected to outlet 23 and, via the on/off switch actuated by switch button 19, to socket 20. Handle 11 may be formed from any suitable material such as wood or plastic.

Reflector 12 may be formed of any suitable material such as aluminum or stainless steel. Reflector 12, generally speaking, has a V-shape comprising a first wall 25 and a second wall 26. Walls 25 and 26 each have a plurality of slits or cutouts 27, and have contoured wall end portions 28, 29 and 30. Slits 27 are provided to enable a small amount of illumination to be radiated from the back or rear 31 of utility lamp 10. In this manner, with bulb 22 lit, some illumination is provided at the back of utility lamp 10 to facilitate working in the general vicinity about utility lamp 10, while providing the major portion of the illumination directed outwardly from reflective surfaces 32 and 33. Each wall 25 and 26 is substantially flat to enable or facilitate placement of the utility lamp 10 on a flat surface such as a table top etc.

Protective cage 13 comprises a plurality of vertical wires or bar like members 34 contoured and bowed outwardly to from a protective shield about a portion of bulb 22. Horizontal cage wires are eliminated, except for the top and bottom support bars 35 and 36, to substantially reduce any snagging with the utility lamp 10 being inserted into a small area having projecting parts such as bolts etc. that may be encountered when, for example, working on an automobile engine (not shown). In this regard it should be also noted that the cage 13 grid wires 34 are contoured inwardly at the top of cage 13 to provide a relatively less obtruding utility lamp 10 configuration to facilitate disposition of utility lamp 10 in confined (work) areas (not shown). Cage 13 is pivotally hinge mounted at its upper support bar 35 such that cage 13 opens vertically as illustrated in FIG. 1. The bottom end support bar 36 has a pair of projecting arms 37 and 38 affixed thereto and configured to form a clamping means about the upper end 39 of handle 11. Arms 37 and 38 are formed of any suitable material to effect a spring bias clamping about a portion of handle 11, with cage 13 in its closed position (see FIGS. 2–4) and to enable a person to unclamp arms 37 and 38 from handle 11 by pulling the bottom portion of cage 13 outwardly from reflector 12.

Tube member 15 generally comprises an elongate, for example, metal, tube or pipe having an internal cavity 41. Tube member 15 may be formed of any suitable material and is affixed to reflector 12 by conventional means such as clamp 55 and bolts 56. Alternatively, tube member 15 may be formed integrally with reflector 12.

Actuating plunger 14 comprises a smaller tube like member 42 open at one end 43 and dimensioned for slidable disposition about the lower portion 44 of tube member 15. A plunger rod 45 is cantilevered affixed/-mounted at one end 46 of the tube member 42 and extends upwardly within the cavity 47 of tube member 42 and cavity 41 of tube member 15. A helical type spring 50 is disposed about plunger rod 45 and between the bottom closed end 51 of tube member 42 and a stop-washer 52. Stop-washer 52 has a central hole (not shown) through which rod 45 is inserted. Stop-washer 52 abuts with the bottom end 53 of tube member 15.

Gripper prongs 17 comprises a plurality of, for example, spring metal, arms 58–61 each being affixed at a bottom end 62 to the upper end 63 of plunger rod 45. The form arms 58–61 each have an upper inwardly protecting finger or hook like member 63–66 respectively. Finger members 63 and 65 are directed inwardly toward each other and, finger members 64 and 66 are directed inwardly toward each other, to form two pairs of grippers having generally diametrically opposing finger members. Each arm 58–61 is biased outwardly such that with the user (not shown) pushing actuating plunger 14 upwardly in opposition to the bias of spring 50, gripper fingers 63–66 are cause to separate as illustrated in FIG. 2. In this disposition, gripper fingers 63–66 may be placed about, for example, a nail head, a screw, pipe or rod or other protruding object. Next, the utility lamp user releases actuator 42, i.e., permits spring 50 to slide actuator 42 downwardly thereby urging gripper fingers 63–66 inwardly to grip or clamp onto the protruding object (not shown). It should be noted at this time that actuator plunger 42 projects downwardly at the rear of handle 11 and in juxtaposition therewith to facilitate actuation, for example, by the utility lamp user's thumb (not shown). In this manner, relatively quick attachment and disconnecting of the gripper fingers may be easily effected while manipulating the lamp 10.

Swivel hook 16 comprises a downwardly projecting arm member 70 and a shaft clamping collar 71. Clamping collar 71 is dimensioned for being disposed about tube 15 and has a tension adjustment means such as nut 72 and bolt 73. Typically, the tension adjustment means is adjusted such that swivel hook 16 may be rotated 360 degrees about tube 15, and slidably disposed upward and downward on the upper end 74 of tube 15 as indicated by the double headed arrow 75. Preferably, clamping collar 71 is adjusted to provide a desired tension and/or resistive/friction drag so that the rotational and elevational disposition of swivel hook 16 retative to reflector 12 may be manually set for selective operating-/mounted uses by the operator. In this manner, utility lamp 10 provides relative versatility and ease of mounting to facilitate illumination of different (work) areas. Swivel hook 16 may be formed of any suitable material.

The electrical connection between the electrical cord 49, bulb receptacle 48, outlet 23 and the on/off switch 19 may be conventional design and, therefore, detailed explanation will not be provided herein to avoid prolixity.

While there has been shown what is considered to be the preferred embodiments of the invention, it is desired to secure in the appended claims all modifications as fall within the true spirit and scope of the invention.

What is claimed is:

1. A lamp device, having particular utility to facilitate placement in a resting position upon a generally flat surface, comprising:

handle means having an electrical outlet member mounted at a bottom end portion of said handle means;

an electrical cord means having one end extending into said bottom end portion and having a second end with an electrical connector plug means affixed thereto;

reflector means mounted to said handle means and having a first wall and a second wall, with each of said first and second walls having a plurality of back-light slits, each of said first and second walls having a generally flat exterior surface;

tube means having a plunger actuator at a first end and a gripper means at a second end, said gripper means being actuable with manual actuation of said plunger actuator;

hook means rotatably and slidably mounted to a portion of said tube means;

protective cage means having a plurality of grill members; and a bulb receptacle mounted in said handle means.

2. A lamp device as in claim 1, wherein:

the handle means has an elongate configuration with a plurality of flat surfaces to facilitate gripping.

3. A lamp device as in claim 1, wherein:

the reflector means has a V-shape comprising a first and a second wall, each of said first and said second walls have a flat portion to facilitate placement of the lamp device on a flat support surface.

4. A lamp device as in claim 3, wherein:

the reflector means has wall portions defining holes to permit light to pass through said holes.

5. A lamp device as in claim 4, wherein:

the reflector means has contoured wall portions to facilitate disposition of the lamp device within a confined space.

6. A lamp device as in claim 1, wherein:

the protective cage means comprises a plurality of spaced contoured generally elongate grill members each affixed at their top ends to an upper cross beam and each affixed at their bottom ends to a lower cross beam, said upper cross beam being privotally mounted to a top hinge portion of said reflector means, a clamp means affixed to said lower cross beam for clampingly securing said lower cross beam to a portion of said handle means while enabling a manual unclamping of said clamp means to permit an upward and outward opening of the protective cage means with said upper cross beam being pivoted at said top hinge portion.

7. A lamp device as in claim 1, wherein:

the tube means comprises an elongate first tube member having an internal cavity, said plunger actuator comprises a second tube member being open at one end and dimensioned for slidable disposition about said first end of said first tube member, a plunger rod cantilevered affixed at a closed end portion of said second tube member and projecting upwardly within said internal cavity, a spring means mounted between a portion of said first tube member and said second tube member for urging said second tube member downwardly;

the gripper means comprises a plurality of arm members each affixed a one end to an upper end portion of said plunger rod, each arm member having an upper hook member, said arm members having an outwardly directing bias whereby with an upward disposition of said second tube member said upper hook members are projected without said internal cavity at the top of said first tube member and biased in an open disposition and with a downward disposition of said second tube member said upper hook members being urged downwardly and inwardly toward each other.

8. A lamp device as in claim 1, wherein:

the hook means comprises a downwardly projecting arm member and a shaft clamping collar means, said shaft clamping collar means being adjustably clamped to a portion of said tube means for being slidable upwardly and downwardly and 360 degree rotatable about said tube means longitudinal axis.

9. A utility lamp, comprising:

handle means (11) having an elongate contoured six sided (18) configuration to facilitate grasping, a push-button switch (19), a lamp bulb receptacle socket (20), an outlet means (23) at a bottom end (24) of said handle means;

an electrical conductive cord means (49) having one end extending within said bottom end (24) of the handle means and being operatively connected to said push-botton switch and to said lamp bulb receptacle socket via said push-botton switch and to said outlet means, and having an electrical plug (100) at its other end;

reflector means (12) being substantially V-shape and comprising a first wall (25) and a second wall (26) each having a plurality of holes (27) therein to enable back-lighting, and having contoured wall end portions (28, 29, 30), said first and second walls having flat portions; protective cage means (13) having a plurality of bar members (34) contoured and bowed outwardly, a first cross bar (35) being hinge (101) mounted at the top of said reflector means and affected to a top end portion of each of said bar members (34), a second cross bar (35) affected to a bottom end portion of each of said bar members (34), a clamp means having a pair of projecting arm members (37, 38) dimensioned for clamping about a portion of said handle (11);

first tube means (15) substantially parallel with the longitudinal axis of said utility lamp (10) and having a first internal cavity (41), said first tube means having an upper portion (74) projecting above the top of said reflector means;

plunger actuator means (14) comprising a second tube member (42) being open at a top end (43) and closed at a bottom end (51), and having a second internal cavity (104) dimensioned for slidably receiving a portion of said first tube means, a plunger rod (45) cantilevered affixed at one end to said bottom end (51) of said second tube member and projecting upwardly within said first internal cavity (41), a stop washer means (52) having a center hole for receiving said plunger rod, a helical spring means (50) disposed between said stop washer means and said bottom end (51) of said second tube member with said stop wahser means abutting an end portion of said first tube means (15), gripper means (17) having a plurality of arm members (58–61) each affixed to a portion of said plunger rod (45), each said arm member having a hook end (63–66) and being leaf spring biased outwardly, said gripper means being urged within said first internal cavity (41) under the spring bias of said helical spring means (50) and said hook ends being extended without said first internal cavity with manual actuation of said plunger actuator means; and swivel hook means (16) having a downwardly projecting arm member (70), a shaft clamping collar (71) and bolt means (72, 73) to enable said swivel hook means to be rotatably and slidably mounted on an upper shaft portion (74) of said first tube means.

* * * * *